US006289885B1

(12) United States Patent
Szadurski

(10) Patent No.: US 6,289,885 B1
(45) Date of Patent: Sep. 18, 2001

(54) HEATING PLATE LEVELLING METHOD

(75) Inventor: Marek Szadurski, Sheffield (GB)

(73) Assignee: Trianco Redfyre Limited, Sheffield (GB)

( * ) Notice: Subject to any disclaimer, the term of this patent is extended or adjusted under 35 U.S.C. 154(b) by 0 days.

(21) Appl. No.: 09/484,990

(22) Filed: Jan. 18, 2000

(30) Foreign Application Priority Data

Feb. 10, 1999 (GB) ..... 9902804

(51) Int. Cl.[7] ..... F24C 15/10

(52) U.S. Cl. ..... 126/39 H; 126/273 R; 126/215

(58) Field of Search ..... 126/39 B, 39 H, 126/214 A, 215, 273 R, 273.5; 248/649, 650

(56) References Cited

U.S. PATENT DOCUMENTS

| | | | | |
|---|---|---|---|---|
| 2,465,155 | * | 3/1949 | Higley | 126/39 H |
| 2,466,979 | * | 4/1949 | Bauer | 126/39 H |
| 2,887,103 | * | 5/1959 | Reeves | 126/214 A |
| 3,307,531 | * | 3/1967 | Thompson | 126/215 |
| 3,375,819 | | 4/1968 | Davis | 126/211 |
| 3,561,796 | | 2/1971 | Williams | 285/106 |
| 3,651,796 | | 3/1972 | Nelson | 126/215 |
| 3,924,602 | * | 12/1975 | Irwin | 126/214 A |
| 4,633,850 | * | 1/1987 | Hawkins | 126/273 R |
| 5,313,929 | * | 5/1994 | Thürk et al. | 126/39 H |
| 5,791,336 | * | 8/1998 | Helm | 126/214 A |
| 5,954,981 | * | 9/1999 | Deo et al. | 126/214 A |

FOREIGN PATENT DOCUMENTS

| | | | | |
|---|---|---|---|---|
| 2143030 | * | 1/1985 | (GB) | 126/39 H |

* cited by examiner

*Primary Examiner*—Sara Clarke
(74) *Attorney, Agent, or Firm*—Woodard, Emhardt, Naughton Moriarty & McNett

(57) ABSTRACT

A heating plate for a heat storage range cooker which is mounted in an aperture in a surrounding surface, on a base in connection with a heat source. The heat source heats the heating plate. In addition, an adjustment mechanism is provided between the heating plate and the base to allow relative movement of the heating plate with respect to the base.

7 Claims, 2 Drawing Sheets

HEATING PLATE LEVELLING METHOD

CROSS-REFERENCE TO RELATED APPLICATIONS

This application claims priority to British Patent Application, Serial No. 9902804.5, filed on Feb. 10, 1998, and entitled, "Heating Plate Levelling Method".

BACKGROUND OF THE INVENTION

The invention to which this application relates is a method for levelling the heating plate of a heat storage range cooker.

Typically a heat storage range cooker comprises at least one heating plate upon which pans and the like are placed for boiling, frying of foodstuffs etc. It is important from the point of view of expansion of the heating plates when hot and also the general appearance and sufficient use of the heating plate that the same be level with respect to the surrounding surface Conventionally, the heating plate is connected to the top end of a heating barrel housed within the cooker and at the lower end of the barrel is a heat source. The heat source which is used for heating the heating plate and oven emits heat into the barrel and the heat passes through the barrel to heat the heating plate.

Currently, in order to adjust the level of the heating plate it is necessary to alter the position of the barrel within the cooker as it is not possible to adjust the heating plate with respect to the barrel. Thus, if levelling is required, the cooker owner is incapable of performing the action and it is necessary for a skilled person to be employed or for the installer to undertake the operation by removing the heating plate, gaining access to the interior of the cooker and then using adjusting bolts on the barrel which allow adjustment of the barrel with respect to the cooker housing in two planes, but separately, to be undertaken. A disadvantage however is that when the adjustment is made, until the heating plate assembly is repositioned on the cooker, it is not possible to ascertain whether the levelling movement has been successful. It is also found that due to the weight of the barrel and heating plate combined, that even when the adjustment has been made, when the heating plate assembly is reassembled, some movement of the heating plate takes place, hence making the adjustment incorrect in some cases which can lead to a need for the whole process to be repeated. It will therefore be appreciated that this process is time consuming and can be frustrating.

BRIEF SUMMARY OF THE INVENTION

The aim of the present invention is to provide a way of altering the level of the heating plate without need for large scale manipulation of the apparatus.

In a first aspect of the invention there is provided a heating plate for a heat storage range cooker, said heating plate mounted in an aperture in a surrounding surface, on a base connected to a heat source via which the heating plate is heated and characterised in that adjustment means are provided between the heating plate and the base to allow relative movement of the heating plate with respect to the base.

In one embodiment, the adjustment means are in the form of a number of bolts which pass through location means in the heating plate and bolt into the base so that relative adjustment between the screws causes relative movement of the heating plate with respect to the base. Thus, these screws can be adjusted to bring the heating plate into level and typically level with the surrounding surface. There is no need to manipulate the heating source or the duct or barrel between the heating source and the heating plate as the heating plate is adjusted with respect to the barrel or duct rather than the whole barrel being adjusted with respect to the cooker as is conventionally the case. Typically the adjustment means are accessed by removing a cover.

In a second aspect of the present invention there is provided a heat storage range cooker including at least one heating plate mounted in an aperture in a surrounding surface, on a base in connection with a heat source via which the at least one heating plate is heated and characterised in that adjustment means are provided between the at least one heating plate and the base to allow relative movement of the at least one heating plate with respect to the base.

In one embodiment the heat storage range cooker is provided with two heating plates and each heating plate is mounted in an aperture in a surrounding surface, on a base and adjustable with respect to the base.

Specific embodiments of the invention will now be described with reference to the accompanying drawings, wherein:

DETAILED DESCRIPTION OF THE INVENTION

Figure 1:
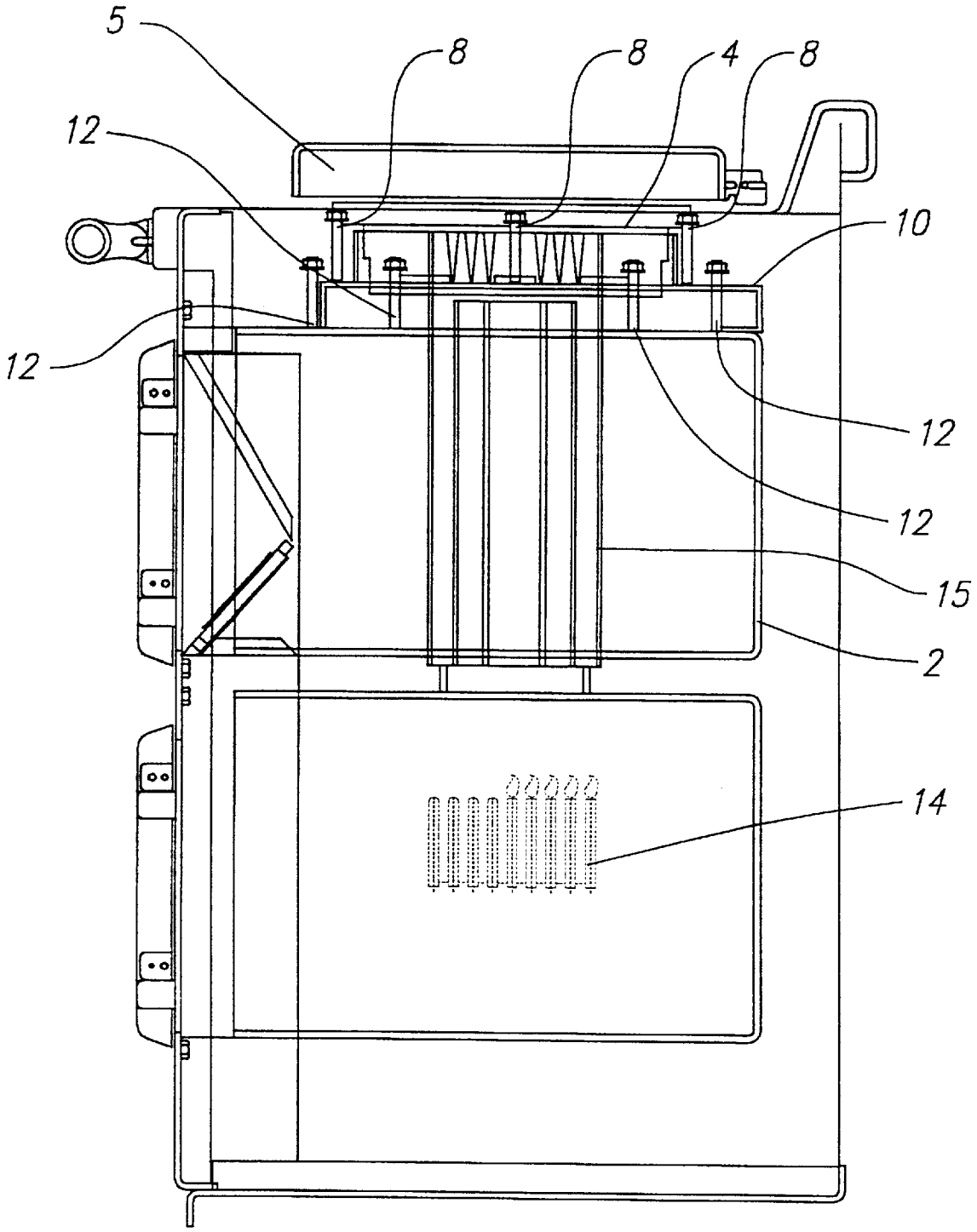
FIG. 1 illustrates an elevation of one embodiment of the invention.

Referring firstly to FIG. 1 there is shown a heat storage range cooker 2 which includes a heating plate 4 for the reception of pots and pans thereon for the heating of the contents and which heating plate is normally closed by a lid (not shown) when not in use. The view is a sectional view to show the interior of the cooker and illustrates how the heating plate 4 is mounted via bolts 8 on a base 10 and said base is in turn bolted to the cooker housing via bolts 12. This is in contrast to conventional cookers where the heating plate and base would be one unit as part of a large barrel depending from the heat source 14 which is shown. Typically the bolts are accessed by removing a cover (not shown).

Figure 2:
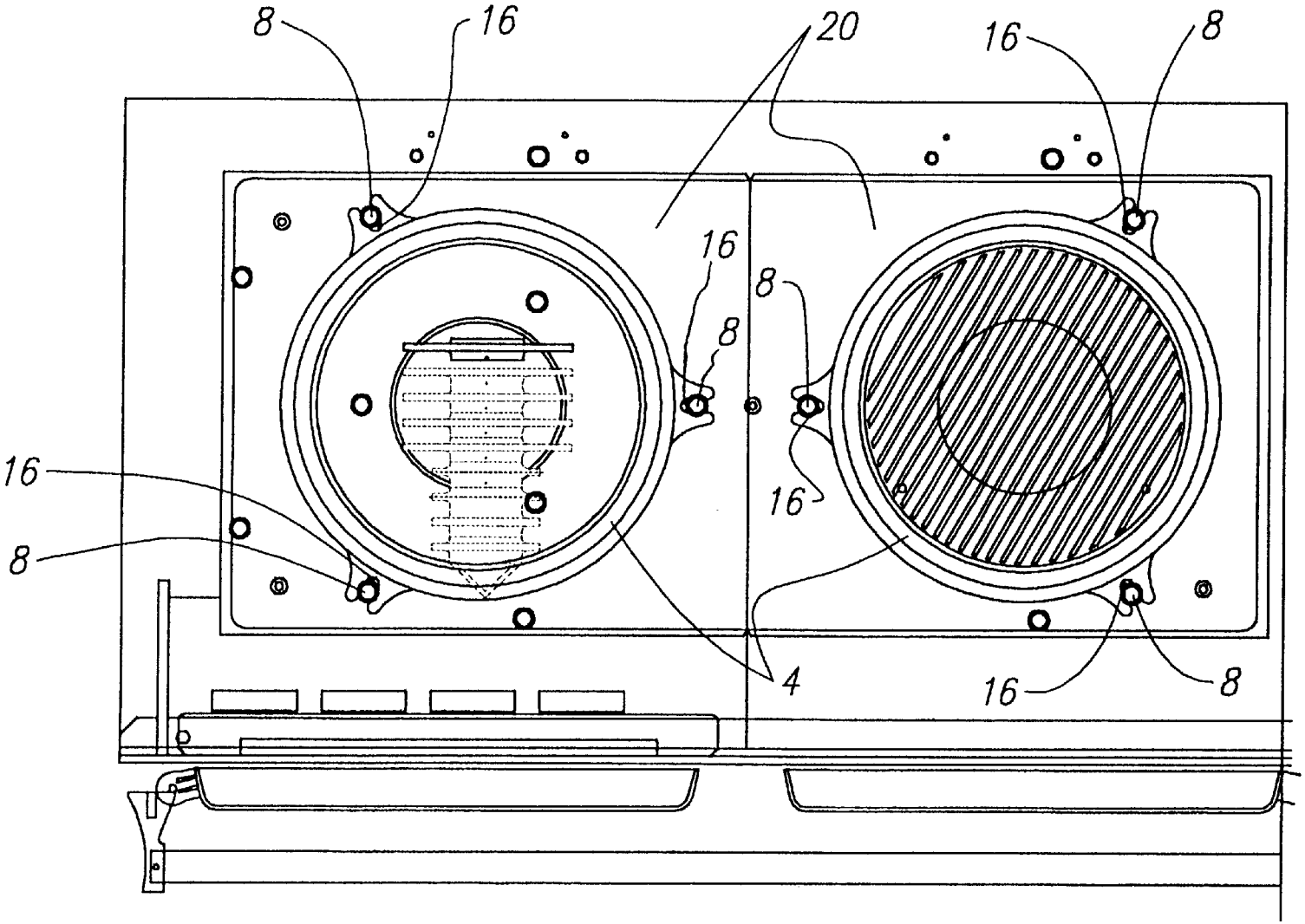
FIG. 2 illustrates a plan view of a heating plate according to the invention.

FIG. 2 illustrates a plan view showing two heating plates 4 both of which are mounted in the same manner as described in FIG. 1 with the bolts 8 passing through grooves 16 in the locating portions on the heating plate 4 and passing onto the base with the bolts typically passing into threaded apertures in the same.

Whereas with conventional cookers it is necessary, if the level of the heating plate is to be adjusted, to alter the level of the entire barrel and the heating plate with it, the current invention allows the heating plate position and level to be adjusted by the manipulation of the respective bolts 8 with respect to the base 10 and with respect to each other. Thus manipulation of one or a number or indeed all of the bolts 8 will be sufficient to bring the heating plate into the required plane such as to be in line with the surrounding surface 20 of the cooker and also parallel with the surrounding surface 20.

The adjustment of the heating plate can be performed manually by the user of the cooker if desired thereby overcoming the need for a specialist engineer to visit and also reduces the time taken to make the adjustment as it is not necessary for any part of the cooker to be removed for the adjustment to be performed.

What is claimed is:

1. A heat storage range cooker including at least one heating plate mounted in an aperture in a surrounding surface and on a base in connection with a heat source via which the at least one heating plate is heated and characterised in that adjustment means are provided between the at least one heating plate and the base to allow relative movement of the at least one heating plate with respect to the base and with reference to the position of the at least one heating plate relative to the surface.

2. The heat storage range cooker according to claim 1 characterised in that the base in turn is mounted on the cooker housing.

3. The heat storage range cooker according to claim 1 characterised in that the position of the base is adjustable with respect to the cooker housing.

4. The heat storage range cooker according to claim 1 characterised in that the heating plate position is adjusted to lie in the plane of the surrounding surface.

5. The heat storage range cooker according to claim 1 characterised in that the heating plate position is adjusted to lie parallel with the plane of the surrounding surface.

6. A heat storage range cooker according to claim 1 characterised in that two heating plates are provided and each heating plate is mounted in an aperture in a surrounding surface, on a base and adjustable with respect to the base.

7. A heating plate according to claim 1 characterised in that the adjustment means are in the form of a number of bolts which pass through location means in the heating plate.

* * * * *